US011659975B2

(12) United States Patent
Ploszaj et al.

(10) Patent No.: US 11,659,975 B2
(45) Date of Patent: May 30, 2023

(54) DISHWASHER HAVING A DOOR ASSEMBLY

(71) Applicant: WHIRLPOOL CORPORATION, Benton Harbor, MI (US)

(72) Inventors: Krzysztof Ploszaj, Dobrzykowice (PL); Arkadiusz Teclaw, Wroclaw (PL)

(73) Assignee: Whirlpool Corporation, Benton Harbor, MI (US)

( * ) Notice: Subject to any disclaimer, the term of this patent is extended or adjusted under 35 U.S.C. 154(b) by 42 days.

(21) Appl. No.: 17/345,030

(22) Filed: Jun. 11, 2021

(65) Prior Publication Data

US 2021/0298559 A1 Sep. 30, 2021

Related U.S. Application Data

(62) Division of application No. 16/594,901, filed on Oct. 7, 2019, now Pat. No. 11,064,861.

(51) Int. Cl.
*A47L 15/42* (2006.01)
*D06F 39/14* (2006.01)

(52) U.S. Cl.
CPC ..... *A47L 15/4263* (2013.01); *A47L 15/4261* (2013.01); *D06F 39/14* (2013.01)

(58) Field of Classification Search
None
See application file for complete search history.

(56) References Cited

U.S. PATENT DOCUMENTS

| | | | | |
|---|---|---|---|---|
| 2,157,943 | A | 5/1939 | Walker et al. | |
| 4,765,697 | A | 8/1988 | Gardell et al. | |
| 5,966,873 | A | 10/1999 | Jerg et al. | |
| 8,460,479 | B2 * | 6/2013 | Haeberle | A47L 15/4257 134/57 D |
| 9,408,519 | B2 | 8/2016 | Fischer et al. | |
| 9,439,552 | B2 | 9/2016 | Fischer et al. | |
| 2010/0141103 | A1 | 6/2010 | Olesen et al. | |

FOREIGN PATENT DOCUMENTS

| | | | |
|---|---|---|---|
| DE | 102013216698 | A1 | 2/2015 |
| DE | 102007052081 | B4 | 7/2016 |
| GB | 2238468 | A | 6/1991 |
| JP | 2002282190 | A | 10/2002 |

* cited by examiner

*Primary Examiner* — Eric W Golightly
(74) *Attorney, Agent, or Firm* — McGarry Bair PC

(57) ABSTRACT

A method of assembling a stiffener to a dishwasher door assembly having an outer door and an inner door spaced from the outer door, the method comprising: positioning a rib from the stiffener adjacent a channel in a side flange of the outer door; rotating the stiffener to insert the rib into the channel; after positioning the rib into the channel, sliding the stiffener until a portion of the stiffener contacts a bottom flange of the outer door; and while the portion of the stiffener abuts the bottom flange, securing the stiffener to the outer door.

16 Claims, 9 Drawing Sheets

DISHWASHER HAVING A DOOR ASSEMBLY

CROSS-REFERENCE TO RELATED APPLICATIONS

This application is a divisional of and claims benefit to U.S. patent application Ser. No. 16/594,901, filed Oct. 7, 2019, now U.S. Pat. No. 11,064,861, issued Jul. 20, 2021, which is incorporated herein by reference in its entirety.

BACKGROUND

Contemporary automatic dishwashers for use in a typical household include a tub that can have an open front and at least partially defines a treating chamber into which items, such as kitchenware, glassware, and the like, can be placed to undergo a washing operation. At least one rack or basket for supporting soiled dishes can be provided within the tub. A spraying system with multiple sprayers can be provided for recirculating liquid throughout the tub to remove soils from the dishes. A door assembly is provided to seal the treating chamber and can include a stiffener to reduce deflection of the door assembly. The stiffener can also serve to improve the user perception of sturdiness and heft of the door assembly.

BRIEF DESCRIPTION

An aspect of the present disclosure relates to a method of assembling a stiffener to a dishwasher door assembly having an outer door and an inner door spaced from the outer door, the method comprising positioning a rib from the stiffener adjacent a channel in a side flange of the outer door assembly, rotating the stiffener to insert the positioning rib into the channel, after positioning the rib into the channel, sliding the stiffener until a portion of the stiffener contacts a bottom flange of the outer door, and while the portion of the stiffener abuts the bottom flange, securing the stiffener to the outer panel.

Another aspect of the present disclosure relates to a method of assembling a dishwasher door having a stiffener, an outer door, and an inner door spaced from the outer door, the method comprising the stiffener being in a first pre-assembled position where a positioning rib from the stiffener is adjacent a channel in a side flange of the outer door, the stiffener being in a second pre-assembled position, rotationally different from the first pre-assembled position relative to the side flange, where the positioning rib is inserted into the channel, and the stiffener being in a third pre-assembled position, translationally different from the first pre-assembled position relative to a bottom flange of the outer door, where a portion of the stiffener is adjacent the bottom flange.

Another aspect of the present disclosure relates to a method of assembling dishwasher door having a stiffener, an outer door and an inner door spaced from the outer door, the method comprising positioning the stiffener next to a front panel of the outer door, positioning a rib from the stiffener adjacent a channel in a side flange of the outer door, simultaneously rotating the stiffener such that the rib fully inserts into the channel and sliding the stiffener until a portion of the stiffener contacts a portion of the outer door, aligning the stiffener with a fastener, and while the portion of the stiffener abuts a bottom flange of the outer door, securing the stiffener to the outer door.

DETAILED DESCRIPTION

Figure 1:
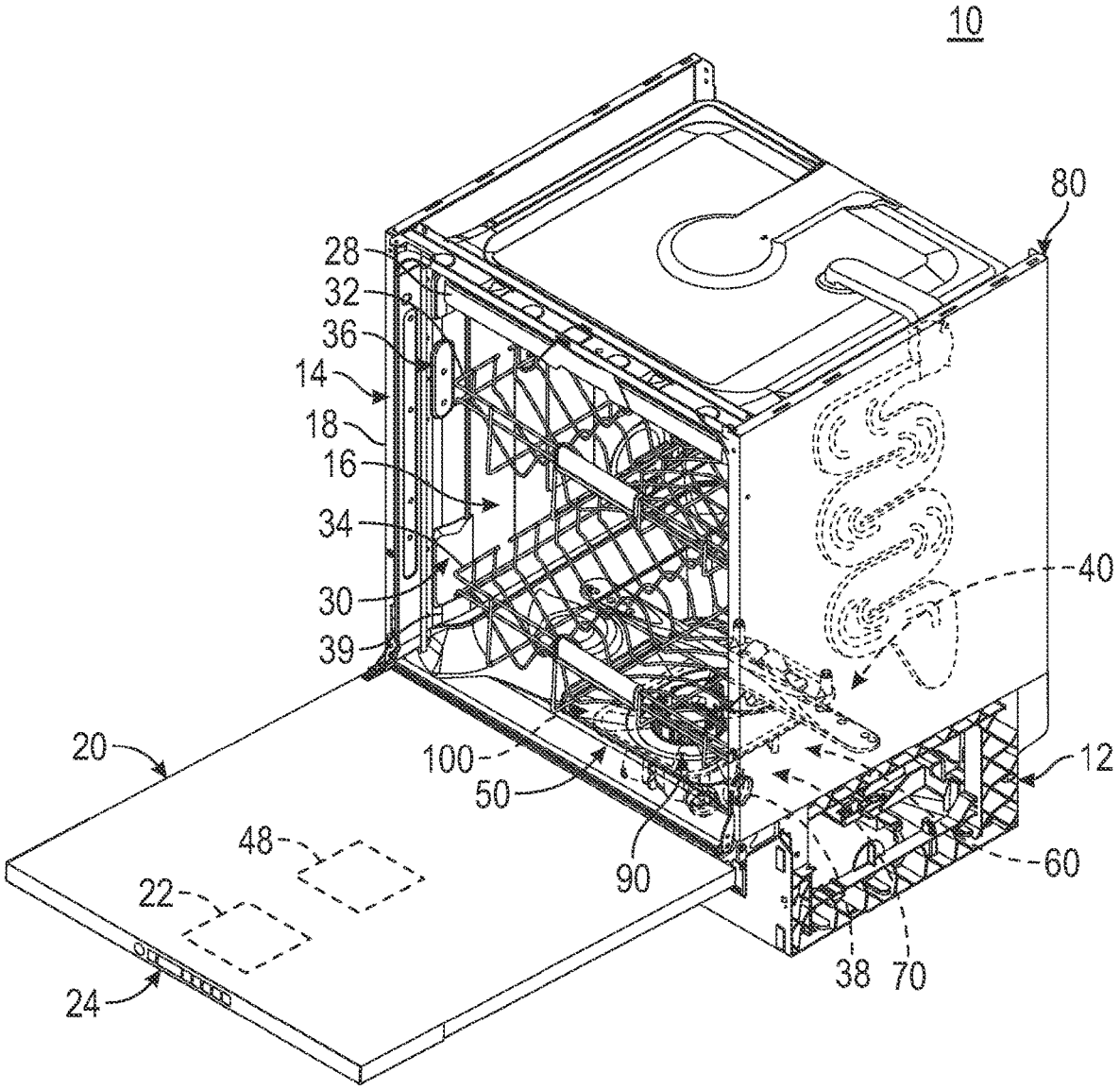
FIG. 1 is a right-side perspective view of an automatic dishwasher having multiple systems for implementing an automatic cycle of operation and having a door assembly in an opened position.

FIG. 1 illustrates an automatic dishwasher 10 capable of implementing an automatic cycle of operation to treat dishes. As used in this description, the term "dish(es)" is intended to be generic to any item, single or plural, that can be treated in the dishwasher 10, including, without limitation, dishes, plates, pots, bowls, pans, glassware, silverware, and other utensils. As illustrated, the dishwasher 10 is a built-in dishwasher implementation, which is designed for mounting under a countertop. However, this description is applicable to other dishwasher implementations such as a stand-alone, multi-tub-type, drawer-type, or a sink-type, for example, as well as dishwashers having varying widths, sizes, and capacities. The dishwasher 10 shares many features of a conventional automatic dishwasher, which may not be described in detail herein except as necessary for a complete understanding of aspects of the disclosure.

The dishwasher 10 has a variety of systems, some of which are controllable, to implement the automatic cycle of operation. A chassis is provided to support the variety of systems needed to implement the automatic cycle of operation. As illustrated, for a built-in implementation, the chassis includes a frame in the form of a base 12 on which is supported a open-faced tub 14, which at least partially defines a treating chamber 16, having an open face 18, for receiving the dishes. A closure in the form of a door assembly 20 can be hingedly or pivotally mounted to the base 12 for movement relative to the tub 14 between opened and closed positions to selectively open and close the open face 18 of the tub 14. In the opened position, a user can access the treating chamber 16, as shown in FIG. 1, while in the closed position, the door assembly 20 covers or closes the open face 18 of the treating chamber 16. Thus, the door assembly 20 provides selective accessibility to the treating chamber 16 for the loading and unloading of dishes or other items.

The chassis, as in the case of the built-in dishwasher implementation, can be formed by other parts of the dishwasher 10, like the tub 14 and the door assembly 20, in addition to a dedicated frame structure, like the base 12, with them all collectively forming a uni-body frame by which the variety of systems are supported. In other implementations, like the drawer-type dishwasher, the chassis can be a tub that is slidable relative to a frame, with the closure being a part of the chassis or the countertop of the surrounding cabinetry. In a sink-type implementation, the sink forms the tub and the cover closing the open top of the sink forms the closure. Sink-type implementations are more commonly found in recreational vehicles.

The systems supported by the chassis, while essentially limitless, can include a dish holding system 30, spray system 40, recirculation system 50, drain system 60, water supply system 70, drying system 80, heating system 90, and filter system 100. These systems are used to implement one or more treating cycles of operation for the dishes, for which there are many, one of which includes a traditional automatic wash cycle.

A basic traditional automatic wash cycle of operation has a wash phase, where a detergent/water mixture is recirculated and then drained, which is then followed by a rinse phase where water alone or with a rinse agent is recirculated and then drained. An optional drying phase can follow the rinse phase. More commonly, the automatic wash cycle has multiple wash phases and multiple rinse phases. The multiple wash phases can include a pre-wash phase where water, with or without detergent, is sprayed or recirculated on the dishes, and can include a dwell or soaking phase. There can be more than one pre-wash phases. A wash phase, where water with detergent is recirculated on the dishes, follows the pre-wash phases. There can be more than one wash phase; the number of which can be sensor controlled based on the amount of sensed soils in the wash liquid. One or more rinse phases will follow the wash phase(s), and, in some cases, come between wash phases. The number of wash phases can also be sensor controlled based on the amount of sensed soils in the rinse liquid. The amounts of water, treating chemistry, and/or rinse aid used during each of the multiple wash or rinse steps can be varied. The wash phases and rinse phases can include the heating of the water, even to the point of one or more of the phases being hot enough for long enough to sanitize the dishes. A drying phase can follow the rinse phase(s). The drying phase can include a drip dry, a non-heated drying step (so-called "air only"), heated dry, condensing dry, air dry or any combination. These multiple phases or steps can also be performed by the dishwasher 10 in any desired combination.

A controller 22 can also be included in the dishwasher 10 and operably couples with and controls the various components of the dishwasher 10 to implement the cycles of operation. The controller 22 can be located within the door assembly 20 as illustrated, or it can alternatively be located somewhere within the chassis. The controller 22 can also be operably coupled with a control panel or user interface 24 for receiving user-selected inputs and communicating information to the user. The user interface 24 can include operational controls such as dials, lights, switches, and displays enabling a user to input commands, such as a cycle of operation, to the controller 22 and receive information, for example about the selected cycle of operation.

The dish holding system 30 can include any suitable structure for receiving or holding dishes within the treating chamber 16. Exemplary dish holders are illustrated in the form of an upper dish rack 32 and lower dish rack 34, commonly referred to as "racks", which are located within the treating chamber 16. The upper dish racks 32 and the lower dish rack 34 define an interior and are typically mounted for slidable movement in and out of the treating chamber 16 through the open face 18 for ease of loading and unloading. Drawer guides/slides/rails 36 are typically used to slidably mount the upper dish rack 32 to the tub 14. The lower dish rack 34 typically has wheels or rollers 38 that roll along rails 39 formed in sidewalls of the tub 14 and onto the door assembly 20, when the door assembly 20 is in the opened position.

Dedicated dish holders can also be provided. One such dedicated dish holder is a third level rack 28 located above the upper dish rack 32. Like the upper dish rack 32, the third level rack is slidably mounted to the tub 14 with drawer guides/slides/rails 36. The third level rack 28 is typically used to hold utensils, such as tableware, spoons, knives, spatulas, etc., in an on-the-side or flat orientation. However, the third level rack 28 is not limited to holding utensils. If an item can fit in the third level rack, it can be washed in the third level rack 28. The third level rack 28 generally has a much shorter height or lower profile than the upper and lower dish racks 32, 34. Typically, the height of the third level rack is short enough that a typical glass cannot be stood vertically in the third level rack 28 and the third level rack 28 still be slid into the treating chamber 16.

Another dedicated dish holder can be a silverware basket (not shown), which is typically carried by one of the upper or lower dish racks 32, 34 or mounted to the door assembly 20. The silverware basket typically holds utensils and the like in an upright orientation as compared to the on-the-side or flat orientation of the third level rack 28.

A dispenser assembly 48 is provided to store and dispense treating chemistry, e.g. detergent, anti-spotting agent, etc., into the treating chamber 16. The dispenser assembly 48 can be mounted on an inner surface of the door assembly 20, as shown, or can be located at other positions within the chassis or treating chamber 16, such that the dispenser assembly 48 is positioned to be accessed by the user for refilling of the dispenser assembly 48, whether it is necessary to refill the dispenser assembly 48 before each cycle (i.e. for a single use dispenser) or only periodically (i.e. for a bulk dispenser). The dispenser assembly 48 can dispense one or more types of treating chemistries. The dispenser assembly 48 can be a single-use dispenser, which holds a single dose of treating chemistry, or a bulk dispenser, which holds a bulk supply of treating chemistry and which is adapted to dispense a dose of treating chemistry from the bulk supply during the cycle of operation, or a combination of both a single use and bulk dispenser. The dispenser assembly 48 can further be configured to hold multiple different treating chemistries. For example, the dispenser assembly 48 can have multiple compartments defining different chambers in which treating chemistries can be held.

Figure 2:
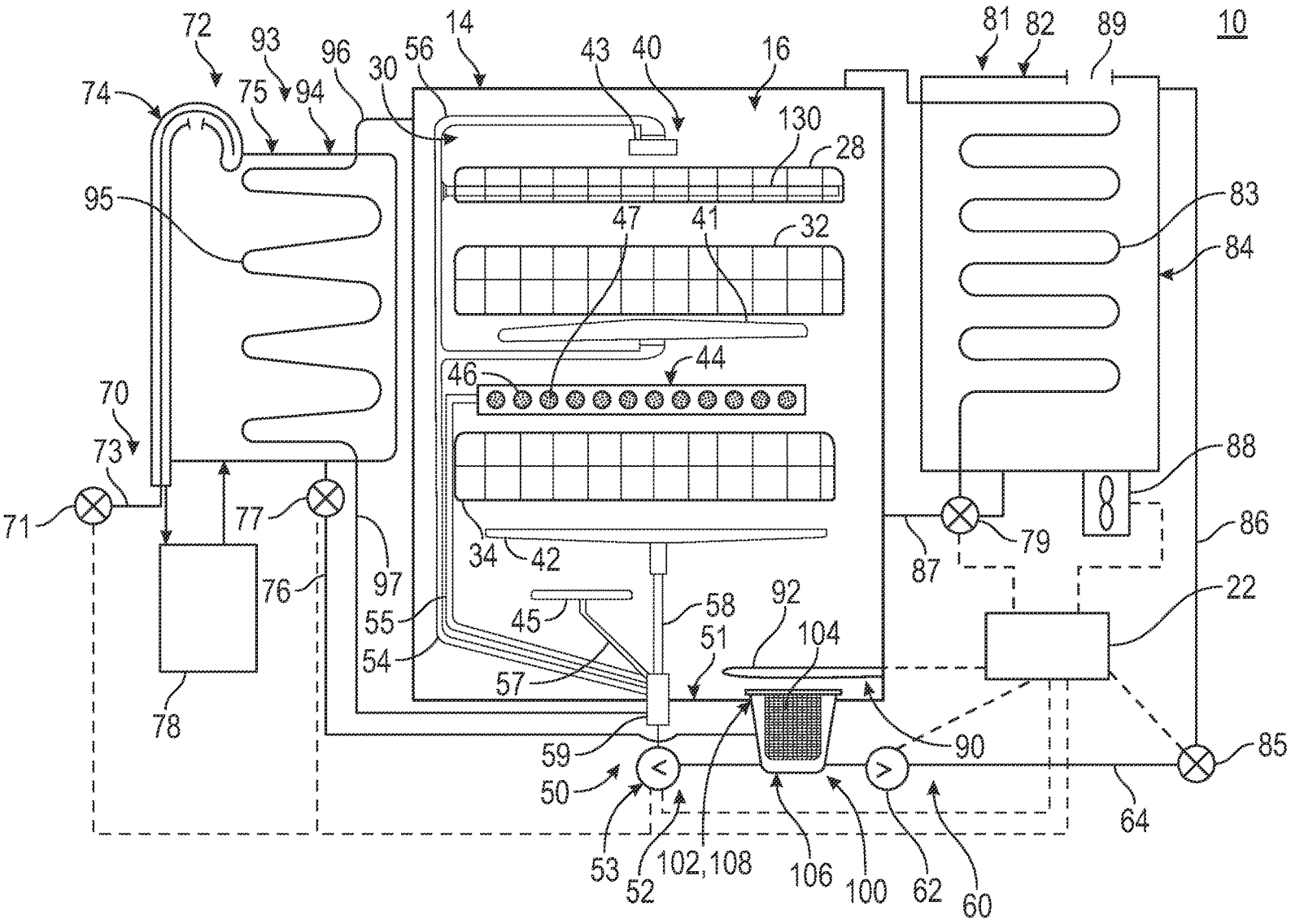
FIG. 2 is a schematic view of the dishwasher of FIG. 1 and illustrating at least some of the plumbing and electrical connections between at least some of systems.

Turning to FIG. 2, the spray system 40 is provided for spraying liquid in the treating chamber 16 and can have multiple spray assemblies or sprayers 41, 42, 43, 44, 45, 130, some of which can be dedicated to a particular one of the dish holders, to particular area of a dish holder, to a particular type of cleaning, or to a particular level of cleaning, etc. The sprayers 41, 42, 43, 44, 45, 130 can be fixed or movable, such as rotating, relative to the treating chamber 16 or dish holder. Exemplary sprayers 41, 42, 43, 44, 45, 130 are illustrated and include, an upper spray arm 41, a lower spray arm 42, a third level sprayer 43, a deep-clean sprayer 44, and a spot sprayer 45. The upper spray arm 41 and lower spray arm 42 can be rotating spray arms, located below the upper dish rack 32 and lower dish rack 34, respectively, and rotate about a generally centrally located and vertical axis. The third level sprayer 43 is located above the third level rack 28. The third level sprayer 43 is illustrated as being fixed, but could move, such as in rotating. In addition to the third level sprayer 43 or in place of the third level sprayer 43, a sprayer 130 can be located at least in part below a portion of the third level rack 28. The sprayer 130 is illustrated as a fixed tube, carried by the third level rack 28, but could move, such as in rotating about a longitudinal axis.

The deep-clean sprayer 44 is a manifold extending along a rear wall of the tub 14 and has multiple nozzles 46, with multiple apertures 47, generating an intensified and/or higher pressure spray than the upper spray arm 41, the lower spray arm 42, or the third level sprayer 43. The nozzles 46 can be fixed or move, such as in rotating. The spray emitted by the deep-clean sprayer 44 defines a deep clean zone, which, as illustrated, would extend along a rear side of the lower dish rack 34. Thus, dishes needing deep cleaning, such as dishes with baked-on food, can be positioned in the lower dish rack 34 to face the deep-clean sprayer 44. The deep-clean sprayer 44, while illustrated as only one unit on a rear wall of the tub 14, could comprise multiple units and/or extend along multiple portions, including different walls, of the tub 14, and can be provided above, below, or beside any of the dish holders wherein deep cleaning is desired.

The spot sprayer 45, like the deep-clean sprayer, can emit an intensified and/or higher pressure spray, especially to a discrete location within one of the dish holders. While the spot sprayer 45 is shown below the lower dish rack 34, it could be adjacent any part of any dish holder or along any wall of the tub where special cleaning is desired. In the illustrated location below the lower dish rack 34, the spot sprayer can be used independently of or in combination with the lower spray arm 42. The spot sprayer 45 can be fixed or can move, such as in rotating.

These sprayers 41, 42, 43, 44, 45, 130 are illustrative examples of suitable sprayers and are not meant to be limiting as to the type of suitable sprayers 41, 42, 43, 44, 45, 130. Additionally, it will be understood that not all of the exemplary sprayers 41, 42, 43, 44, 45, 130 need be included within the dishwasher 10, and that less than all of the sprayers 41, 42, 43, 44, 45, 130 described can be included in a suitable dishwasher 10.

The recirculation system 50 recirculates the liquid sprayed into the treating chamber 16 by the sprayers 41, 42, 43, 44, 45, 130 of the spray system 40 back to the sprayers 41, 42, 43, 44, 45, 130 to form a recirculation loop or circuit by which liquid can be repeatedly and/or continuously sprayed onto dishes in the dish holders. The recirculation system 50 can include a sump 51 and a pump assembly 52. The sump 51 collects the liquid sprayed in the treating chamber 16 and can be formed by a sloped or recess portion of a bottom wall of the tub 14. The pump assembly 52 can include one or more pumps such as recirculation pump 53. The sump 51 can also be a separate module that is affixed to the bottom wall and include the pump assembly 52.

Multiple supply conduits 54, 55, 56, 57, 58 fluidly couple the sprayers 41, 42, 43, 44, 45, 130 to the recirculation pump 53. A recirculation valve 59 can selectively fluidly couple each of the conduits 54-58 to the recirculation pump 53. While each sprayer 41, 42, 43, 44, 45, 130 is illustrated as having a corresponding dedicated supply conduit 54-58, one or more subsets, comprising multiple sprayers from the total group of sprayers 41, 42, 43, 44, 45, 130, can be supplied by the same conduit, negating the need for a dedicated conduit 54-58 for each sprayer 41, 42, 43, 44, 45, 130. For example, a single conduit can supply the upper spray arm 41 and the third level sprayer 43. Another example is that the sprayer 130 is supplied liquid by the conduit 56, which also supplies the third level sprayer 43.

The recirculation valve 59, while illustrated as a single valve, can be implemented with multiple valves. Additionally, one or more of the conduits 54-58 can be directly coupled to the recirculation pump 53, while one or more of the other conduits 54-58 can be selectively coupled to the recirculation pump 53 with one or more valves. There are essentially an unlimited number of plumbing schemes to connect the recirculation system 50 to the spray system 40. The illustrated plumbing is not limiting.

The drain system 60 drains liquid from the treating chamber 16. The drain system 60 includes a drain pump 62 fluidly coupling the treating chamber 16 to a drain line 64. As illustrated, the drain pump 62 fluidly couples the sump 51 to the drain line 64.

While separate recirculation 53 and drain pumps 62 are illustrated, a single pump can be used to perform both the recirculating and the draining functions, such as by configuring the single pump to rotate in opposite directions, or by providing a suitable valve system. Alternatively, the drain pump 62 can be used to recirculate liquid in combination with the recirculation pump 53. When both a recirculation pump 53 and drain pump 62 are used, the drain pump 62 is typically more robust than the recirculation pump 53 as the drain pump 62 tends to have to remove solids and soils from the sump 51, unlike the recirculation pump 53, which tends to recirculate liquid which has solids and soils filtered away to at least some extent.

A water supply system 70 is provided for supplying fresh water to the dishwasher 10 from a water supply source, such as a household water supply via a household water valve 71. The water supply system 70 includes a water supply unit 72 having a water supply conduit 73 with a siphon break 74. While the water supply conduit 73 can be directly fluidly coupled to the tub 14 or any other portion of the dishwasher 10, the water supply conduit is shown fluidly coupled to a supply tank 75, which can store the supplied water prior to use. The supply tank 75 is fluidly coupled to the sump 51 by a supply line 76, which can include a controllable valve 77 to control when water is released from the supply tank 75 to the sump 51.

The supply tank 75 can be conveniently sized to store a predetermined volume of water, such as a volume required for a phase of the cycle of operation, which is commonly referred to as a "charge" of water. The storing of the water in the supply tank 75 prior to use is beneficial in that the water in the supply tank 75 can be "treated" in some manner, such as softening or heating prior to use.

A water softener 78 can be provided with the water supply system 70 to soften the fresh water. The water softener 78 is shown fluidly coupling the water supply conduit 73 to the supply tank 75 so that the supplied water automatically passes through the water softener 78 on the way to the supply tank 75. However, the water softener 78 could directly supply the water to any other part of the dishwasher 10 than the supply tank 75, including directly supplying the tub 14. Alternatively, the water softener 78 can be fluidly coupled downstream of the supply tank 75, such as in-line with the supply line 76. Wherever the water softener 78 is fluidly coupled, it can be done so with controllable valves, such that the use of the water softener 78 is controllable and not mandatory.

A drying system 80 is provided to aid in the drying of the dishes during the drying phase. The drying system as illustrated includes a condensing assembly 81 having a condenser 82 formed of a serpentine conduit 83 with an inlet fluidly coupled to an upper portion of the tub 14 and an outlet fluidly coupled to a lower portion of the tub 14, whereby moisture laden air within the tub 14 is drawn from the upper portion of the tub 14, passed through the serpentine conduit 83, where liquid condenses out of the moisture laden air and is returned to the treating chamber 16 where it ultimately evaporates or is drained via the drain pump 62. The serpentine conduit 83 can be operated in an open loop configuration, where the air is exhausted to atmosphere, a closed loop configuration, where the air is returned to the treating chamber, or a combination of both by operating in one configuration and then the other configuration.

To enhance the rate of condensation, the temperature difference between the exterior of the serpentine conduit 83 and the moisture laden air can be increased by cooling the exterior of the serpentine conduit 83 or the surrounding air. To accomplish this, an optional cooling tank 84 is added to the condensing assembly 81, with the serpentine conduit 83 being located within the cooling tank 84. The cooling tank 84 is fluidly coupled to at least one of the spray system 40, recirculation system 50, drain system 60 or water supply system 70 such that liquid can be supplied to the cooling tank 84. The liquid provided to the cooling tank 84 from any of the systems 40-70 can be selected by source and/or by phase of cycle of operation such that the liquid is at a lower temperature than the moisture laden air or even lower than the ambient air.

As illustrated, the liquid is supplied to the cooling tank 84 by the drain system 60. A valve 85 fluidly connects the drain line 64 to a supply conduit 86 fluidly coupled to the cooling tank 84. A return conduit 87 fluidly connects the cooling tank 84 back to the treating chamber 16 via a return valve 79. In this way a fluid circuit is formed by the drain pump 62, drain line 64, valve 85, supply conduit 86, cooling tank 84, return valve 79 and return conduit 87 through which liquid can be supplied from the treating chamber 16, to the cooling tank 84, and back to the treating chamber 16. Alternatively, the supply conduit 86 could fluidly couple to the drain line 64 if re-use of the water is not desired.

To supply cold water from the household water supply via the household water valve 71 to the cooling tank 84, the water supply system 70 would first supply cold water to the treating chamber 16, then the drain system 60 would supply the cold water in the treating chamber 16 to the cooling tank 84. It should be noted that the supply tank 75 and cooling tank 84 could be configured such that one tank performs both functions.

The drying system 80 can use ambient air, instead of cold water, to cool the exterior of the serpentine conduit 83. In such a configuration, a blower 88 is connected to the cooling tank 84 and can supply ambient air to the interior of the cooling tank 84. The cooling tank 84 can have a vented top 89 to permit the passing through of the ambient air to allow for a steady flow of ambient air blowing over the serpentine conduit 83.

The cooling air from the blower 88 can be used in lieu of the cold water or in combination with the cold water. The cooling air will be used when the cooling tank 84 is not filled with liquid. Advantageously, the use of cooling air or cooling water, or combination of both, can be selected based on the site-specific environmental conditions. If ambient air is cooler than the cold water temperature, then the ambient air can be used. If the cold water is cooler than the ambient air, then the cold water can be used. Cost-effectiveness can also be considered when selecting between cooling air and cooling water. The blower 88 can be used to dry the interior of the cooling tank 84 after the water has been drained. Suitable temperature sensors for the cold water and the ambient air can be provided and send their temperature signals to the controller 22, which can determine which of the two is colder at any time or phase of the cycle of operation.

A heating system 90 is provided for heating water used in the cycle of operation. The heating system 90 includes a heater 92, such as an immersion heater, located in the treating chamber 16 at a location where it will be immersed by the water supplied to the treating chamber 16, such as within or near the sump 51. However, it will also be understood that the heater 92 need not be an immersion heater; it can also be an in-line heater located in any of the conduits. There can also be more than one heater 92, including both an immersion heater and an in-line heater. The heater 92 can also heat air contained in the treating chamber 16. Alternatively, a separate heating element (not shown) can be provided for heating the air circulated through the treating chamber 16.

The heating system 90 can also include a heating circuit 93, which includes a heat exchanger 94, illustrated as a serpentine conduit 95, located within the supply tank 75, with a supply conduit 96 supplying liquid from the treating chamber 16 to the serpentine conduit 95, and a return conduit 97 fluidly coupled to the treating chamber 16. The heating circuit 93 is fluidly coupled to the recirculation pump 53 either directly or via the recirculation valve 59 such that liquid that is heated as part of a cycle of operation can be recirculated through the heat exchanger 94 to transfer the heat to the charge of fresh water residing in the supply tank 75. As most wash phases use liquid that is heated by the heater 92, this heated liquid can then be recirculated through the heating circuit 93 to transfer the heat to the charge of water in the supply tank 75, which is typically used in the next phase of the cycle of operation.

A filter system 100 is provided to filter un-dissolved solids from the liquid in the treating chamber 16. The filter system 100 includes a coarse filter 102 and a fine filter 104, which can be a removable basket 106 residing the sump 51, with the coarse filter 102 being a screen 108 circumscribing the removable basket 106. Additionally, the recirculation system 50 can include a rotating filter in addition to or in place of the either or both of the coarse filter 102 and fine filter 104. Other filter arrangements are contemplated such as an ultra-filtration system.

Figure 3:
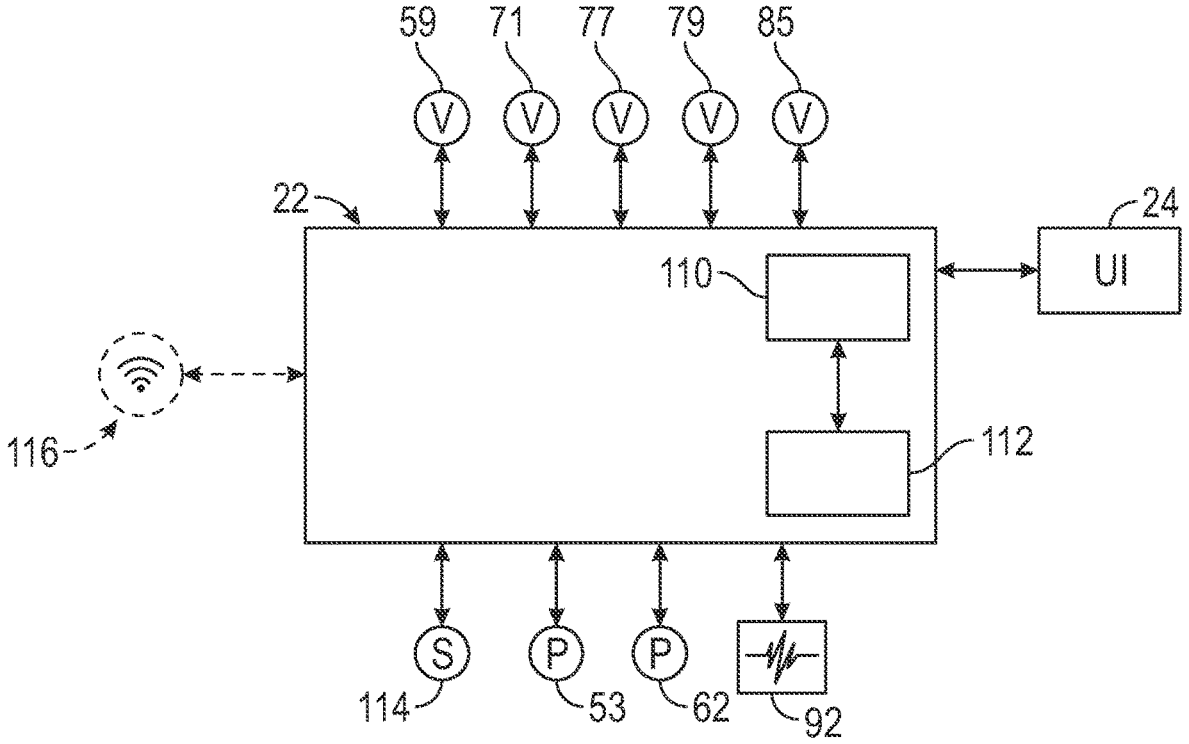
FIG. 3 is a schematic view of a controller of the dishwasher of FIGS. 1 and 2.

As illustrated schematically in FIG. 3, the controller 22 can be coupled with the heater 92 for heating the wash liquid during a cycle of operation, the drain pump 62 for draining liquid from the treating chamber 16, the recirculation pump 53 for recirculating the wash liquid during the cycle of operation, and the dispenser assembly 48 for selectively dispensing treating chemistry to the treating chamber 16. The controller 22 can be provided with a memory 110 and a central processing unit (CPU) 112. The memory 110 can be used for storing control software that can be executed by the CPU 112 in completing a cycle of operation using the dishwasher 10 and any additional software. For example, the memory 110 can store one or more pre-programmed automatic cycles of operation that can be selected by a user and executed by the dishwasher 10. The controller 22 can also receive input from one or more sensors 114. Non-limiting examples of sensors that can be communicably coupled with the controller 22 include, to name a few, ambient air temperature sensor, treating chamber temperature sensor, water supply temperature sensor, door open/close sensor, and turbidity sensor to determine the soil load associated with a selected grouping of dishes, such as the dishes associated with a particular area of the treating chamber. The controller 22 can also communicate with the recirculation valve 59, the household water valve 71, the controllable valve 77, the return valve 79, and the valve 85. Optionally, the controller 22 can include or communicate with a wireless communication device 116.

Figure 4:
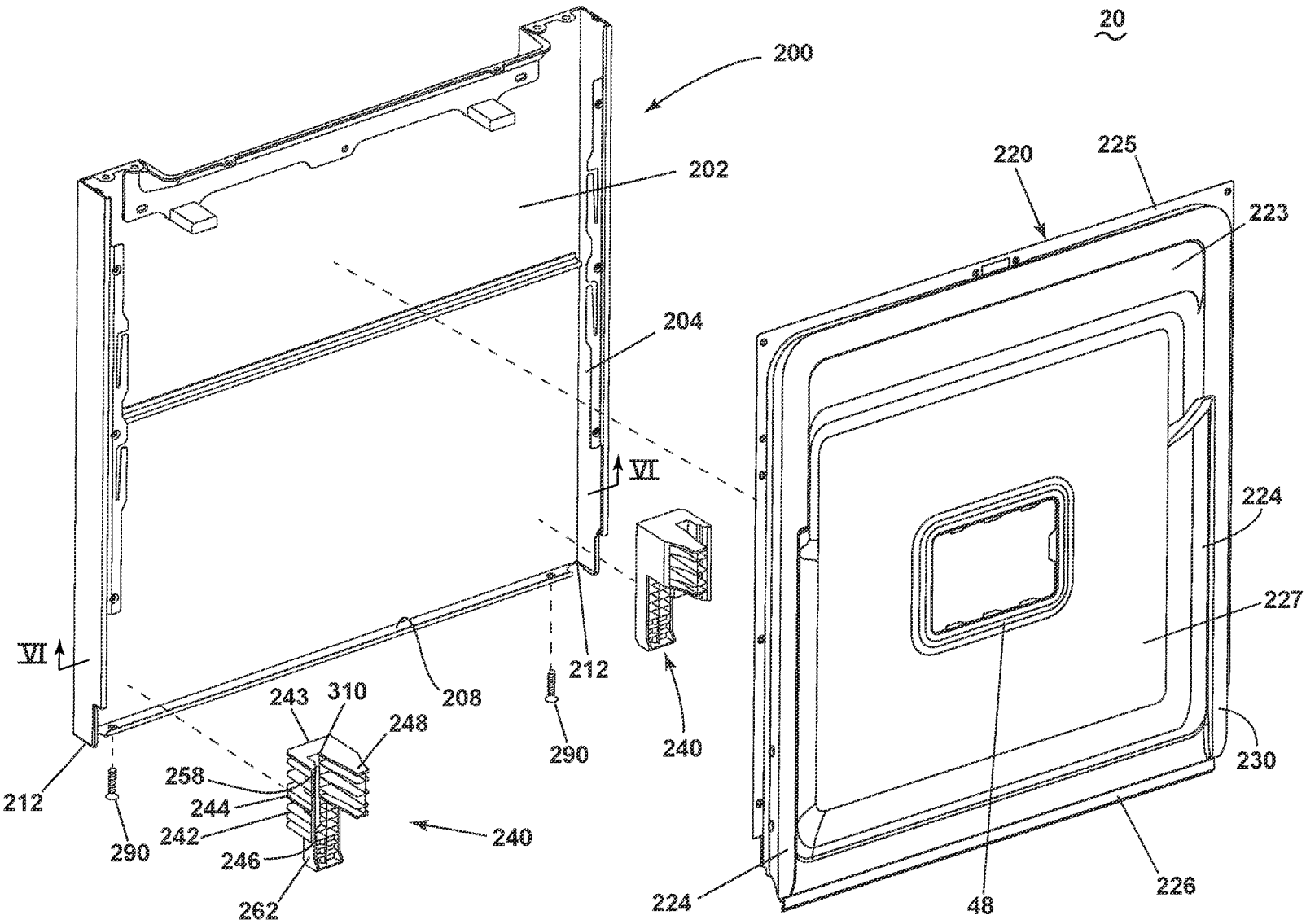
FIG. 4 is a rear perspective view of a door assembly of the dishwasher of FIG. 1 with an inner panel removed for clarity.

FIG. 4 illustrates an exploded view of the door assembly 20 that can be provided with dishwasher 10, which includes an outer door 200, inner door 220, with stiffeners 240 and fasteners 290 in the lower corners. The outer door 200 has a front panel 202 with side flanges 204 and a bottom flange 208, with the side edges and bottom edge defining the lower corners.

The outer door 200 includes a front panel 202, side flanges 204, and a bottom flange 208. The side flanges 204 and bottom flange 208 at least partially form lower corners 212 where the stiffeners are located.

The inner door 220 includes a rear panel 223 with side edges 224, top edge 225, and bottom edge 226. A depression 227 is formed in the rear panel 223, which, in combination with at least some of the side edges 224, top edge 225, and bottom edge 226, effectively form a second channel 230, which is present at least along a portion of the side edges 224. The second channel 230 can extend about the periphery of the depression 227. The second channel 230 can also be formed without the depression 227. The depression 227 is advantageous in that it provides more interior room for the dishwasher. A dispenser assembly 48 can be located in the depression 227.

The stiffener 240 consists of a body 242 and a finger 262. The body 242 has a first projection 248 and a second projection 258 from which a rib 246 extends. The first projection 248 and the second projection 258 are spaced and define an intervening gap 310. The stiffener 240 further has a first surface 243 and a second surface 244. While the first surface 243 is shown as a continuously planar face of the body 242, it could be formed by multiple ribs or projections like the second surface.

Figure 5:
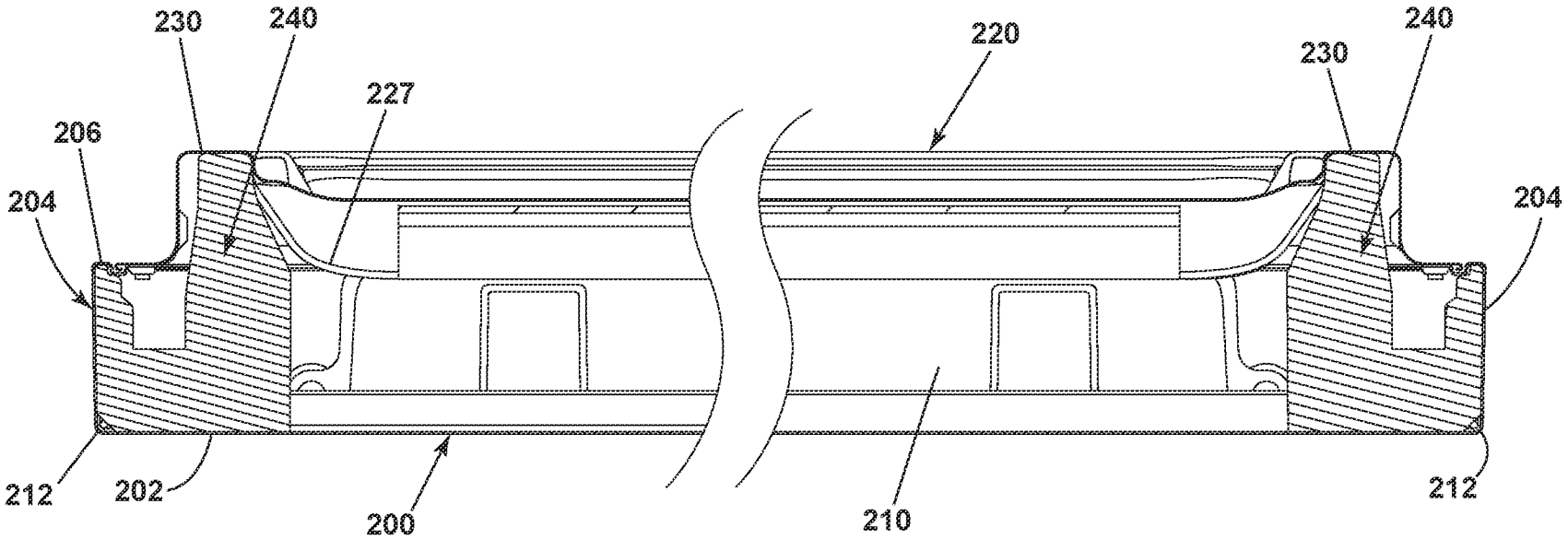
FIG. 5 is an exploded view of the door assembly of the dishwasher of FIG. 1 illustrating an outer panel, inner panel and stiffeners.

FIG. 5 illustrates a cross-sectional view of the door assembly 20 showing the relative positioning of the outer door 200, the inner door 220 and the stiffeners 240 of the door assembly 20, when the outer door 200 is assembled to the inner door 220. The outer door 200 and the inner door 220 define an interior space 210. The stiffeners 240 are located in the interior space 210 and at the lower corners 212.

Figure 6:
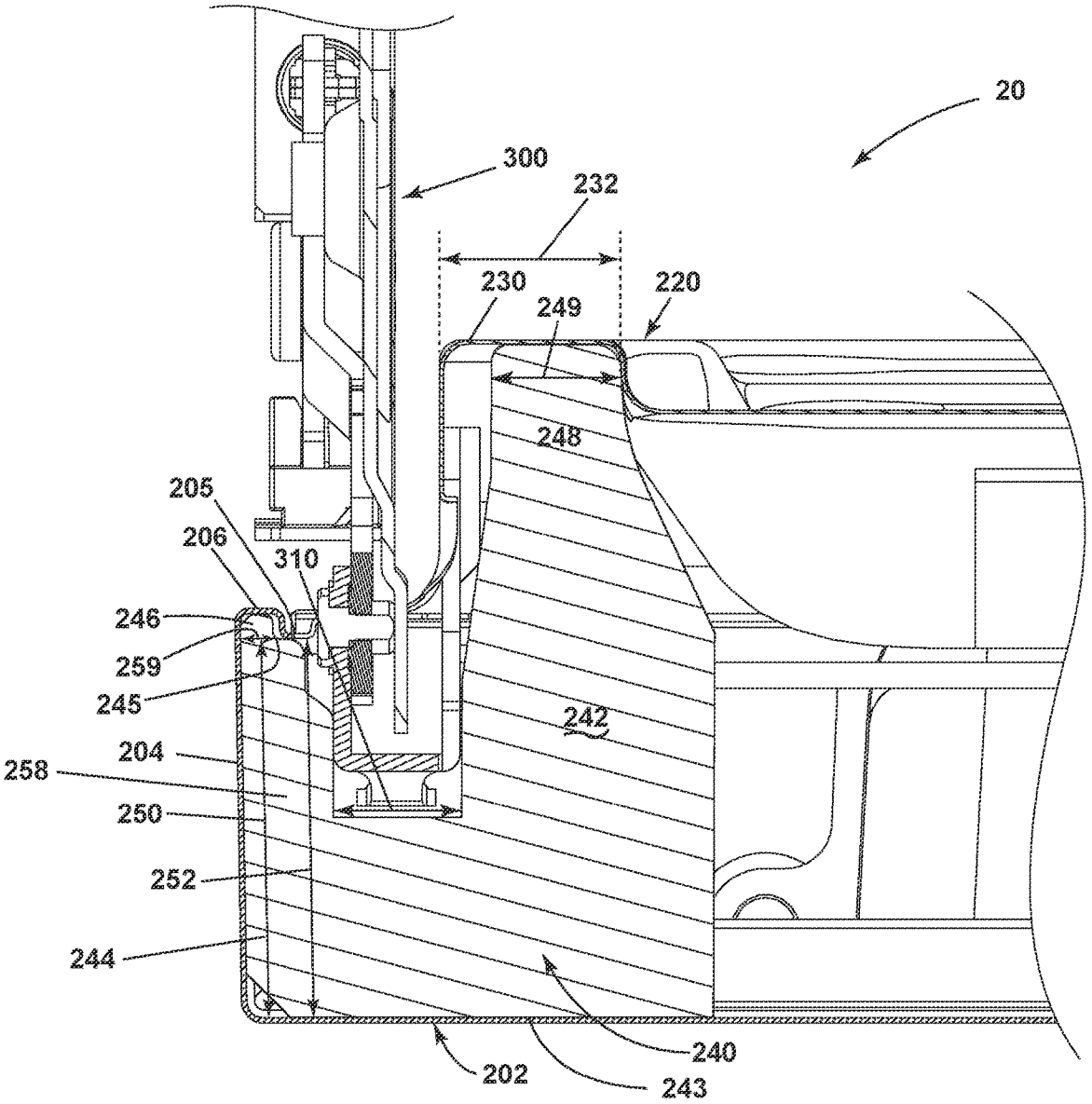
FIG. 6 is a cross-sectional view of the door assembly of FIG. 4 with the addition of the inner panel and including one including a hinge assembly.

FIG. 6. is an enlarged cross-sectional view of one of the corners of FIG. 5 with a hinge assembly 300 in place. The enlarged cross-section of FIG. 6 better illustrates some of the details. For example, the side flanges 204 are shaped to define a first channel 206. The first channel 206 overlies and confronts the front panel 202. The second channel 230 of inner door 220 confronts the front panel 202.

The stiffener 240 is located such that the first surface 243 abuts the front panel 202 and the second surface 244 abuts the side flange 204. The rib 246 is received within the first channel 206. The first projection 248 is received within the second channel 230. The width of the rib 246 is sized to be received within the first channel 206. While the rib 246 could be oversized to provide an interference fit with the first channel 206, it is contemplated the rib 246 will have a width that is the same or less than a width 259 of the first channel 206. The rib 246 defines a first step 245 in the body 242 and the first channel 206 defines a second step 205 in the side flange 204. The first step 245 and the second step 205 seat together as is shown in FIG. 6. A first distance 250 between the first surface 243 and the rib 246 can be greater than or at least equal to a second distance 252 between the front panel 202 and an opening to the first channel 206.

The first projection 248 has a first width 249 less than a width 232 of the second channel 230. While the first projection 248 can be located within the second channel 230 in any suitable manner, it is shown to have an interference fit with at least a portion of the second channel 230, such as the portion of the depression 227 forming part of the second channel 230. While such an interference fit is not necessary, it helps to hold the parts together and prevent their relative movement.

Figure 7:
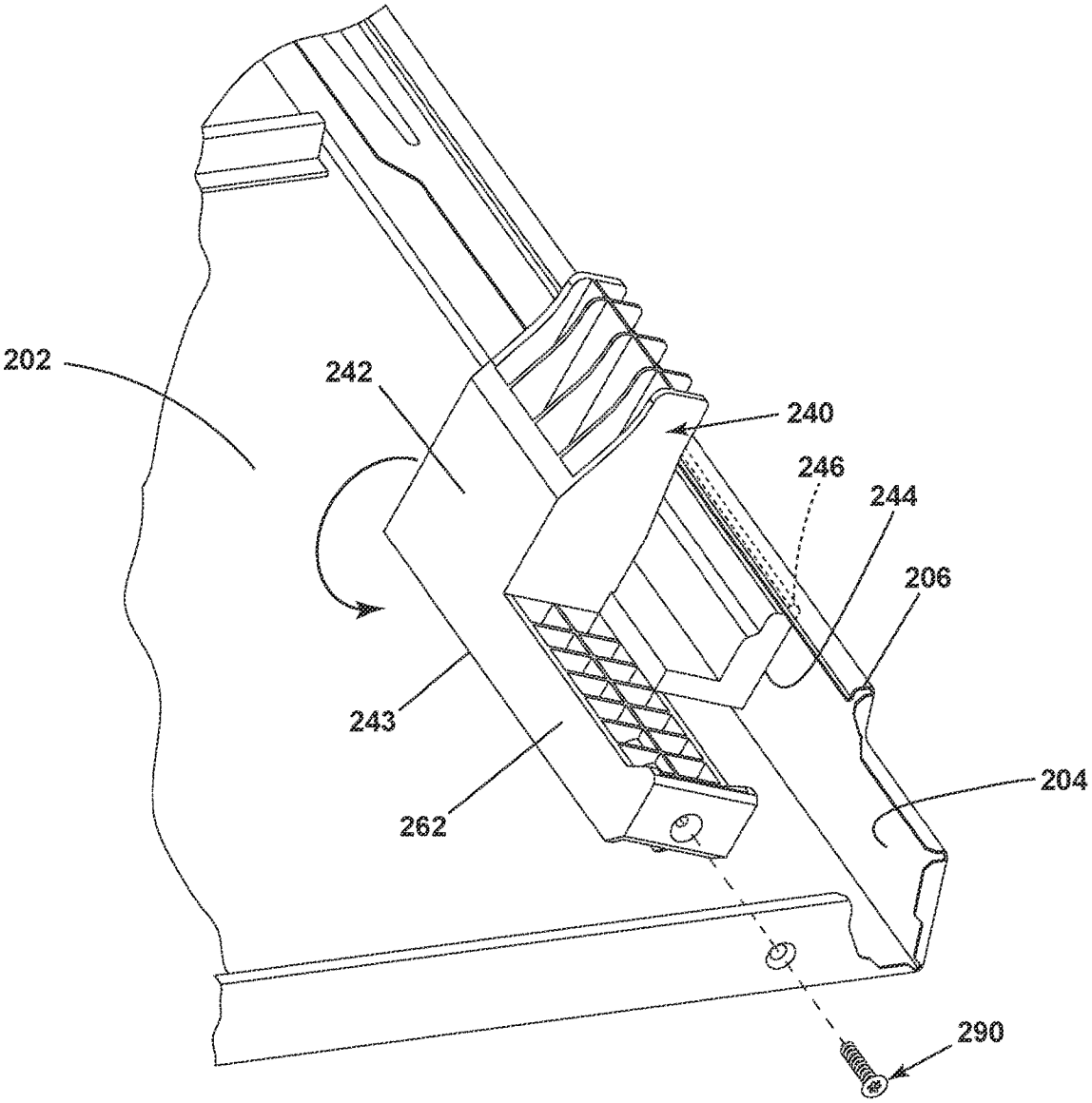
FIG. 7 is a perspective view of the stiffener of FIG. 4 in a first pre-assembled position.

The structure of the stiffener 240 provides for easy assembly with the outer and inner doors to form the door assembly 20. The method of assembly begins as is shown in FIG. 7, with a first pre-assembled position of the stiffener 240 next to the front panel 202. In this first pre-assembled position, the rib 246 is positioned adjacent the first channel 206 in the side flange 204 of the outer door 200. The alignment of the fastener 290 with the stiffener 240 is illustrated. In the position, the stiffener 240 can be rotated in the direction of the arrow shown in FIG. 7. Rotation in this position will further insert the rib 246 into the first channel 206.

Figure 8:
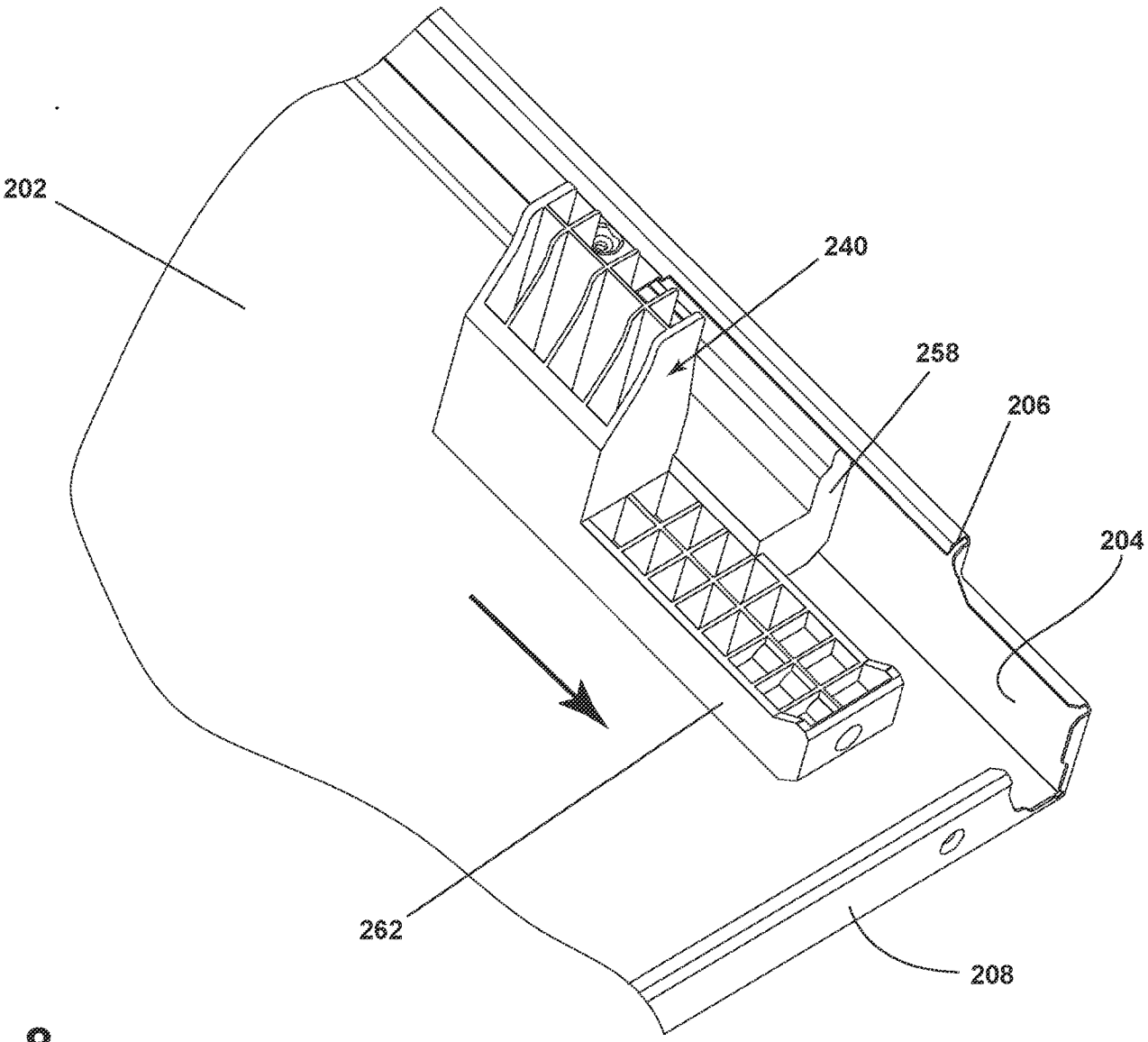
FIG. 8 is a perspective view of the stiffener of FIG. 4 in a second pre-assembled position.

After the rotation is completed, the stiffener is in the position shown in FIG. 8, which is a second pre-assembled position, in which the rib 246 of the stiffener 240 is fully inserted into the first channel 206 and the second surface 244 abuts the side flange 204. Once the rotation is complete and the stiffener is in the second pre-assembled position, the stiffener can be slid in the direction of the arrow in FIG. 8, until the finger 262 abuts the bottom flange 208. While it is contemplated that the stiffener 240 will be fully rotated before sliding, it is possible to simultaneously rotate and slide the stiffener, as it is possible to partially rotate and slide the stiffener.

Figure 9:
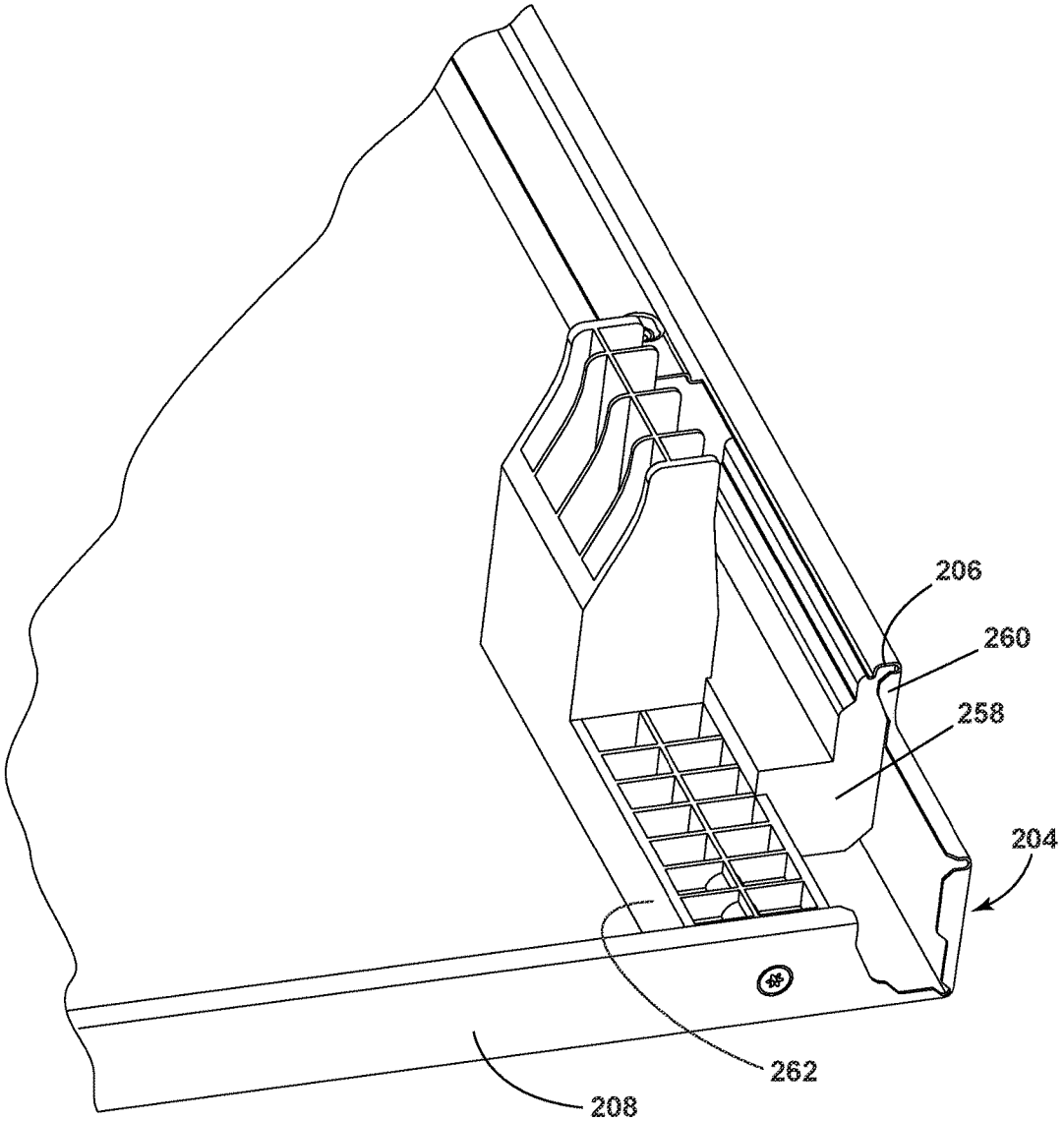
FIG. 9 is a perspective view of the stiffener of FIG. 4 in a third pre-assembled position.

When the stiffener is slid until the finger 262 abuts the bottom flange 208, it is in the position shown in FIG. 9, which is a third pre-assembled position in which the rib 246 of the stiffener 240 is installed within the first channel 206, the second surface 244 abuts the side flange 204 and the second projection 258 abuts against the stop 260. The front panel 202 comprises a stop 260 abutting the body 242. In this position, the finger 262 can be secured with a fastener (including but not limited to a screw) to the bottom flange.

The aspects described herein can be used to provide a door assembly with a stiffener for a dishwasher that is configured for improved rigidity of the door. Having a space between the inner door and the outer door of a dishwasher door assembly can result in a perception of weakness, reduced stability with regard to deflection. By placing the stiffener in the space between the inner and outer door, the rigidity of the door can be improved. Engaging the stiffener within a channel of and fastening the stiffener to the door panel further increases the connection between the stiffener and the door panels and thereby improves the stability and reduces the flexibility of the door assembly.

It will also be understood that various changes and/or modifications can be made without departing from the spirit of the present disclosure. By way of non-limiting example, although the present disclosure is described for use with a door assembly pivotable about a horizontal axis, it will be recognized that the door assembly can be employed with various constructions, including door assemblies pivotable about a vertical axis and/or door assemblies for drawer-style dishwashers.

To the extent not already described, the different features and structures of the various aspects can be used in combination with each other as desired. That one feature is not illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A method of assembling a stiffener to a dishwasher door assembly having an outer door and an inner door spaced from the outer door, the method comprising:

positioning a rib from the stiffener adjacent a channel in a side flange of the outer door;

rotating the stiffener to insert the rib into the channel; after positioning the rib into the channel, sliding the stiffener until a portion of the stiffener contacts a bottom flange of the outer door; and while the portion of the stiffener abuts the bottom flange, securing the stiffener to the outer door.

2. The method of claim 1 wherein the securing comprises fastening the portion of the stiffener to the bottom flange.

3. The method of claim 1 further comprising pressing a portion of the inner door onto a portion of the stiffener.

4. The method of claim 3 wherein the pressing comprises overcoming an interference fit between the portion of the inner door and the portion of the stiffener.

5. The method of claim 4 wherein the interference fit is created by a portion of the rib being larger than a portion of the channel.

6. The method of claim 1 further comprising mounting a hinge assembly to the dishwasher door assembly.

7. The method of claim 6 wherein the mounting includes inserting a portion of the hinge assembly into a gap in the stiffener.

8. The method of claim 7 wherein the gap in the stiffener is aligned with a space between the inner and outer doors.

9. A method of assembling a dishwasher door having a stiffener, an outer door, and an inner door spaced from the outer door, the method comprising:

positioning the stiffener into a first pre-assembled position where a positioning rib from the stiffener is adjacent a channel in a side flange of the outer door;

rotating the stiffener into a second pre-assembled position, rotationally different from the first pre-assembled position relative to the side flange, where the positioning rib is inserted into the channel; and sliding the stiffener into a third pre-assembled position, translationally different from the first pre-assembled position relative to a bottom flange of the outer door, where a portion of the stiffener is adjacent the bottom flange.

10. The method of claim 9 further comprising using a fourth pre-assembled position where a fastener secures the stiffener to the bottom flange.

11. The method of claim 9 wherein, in the second pre-assembled position, the position rib is fully inserted into the channel.

12. The method of claim 9 wherein, in the second pre-assembled position, there is an interference fit between the positioning rib and the channel.

13. The method of claim 9 wherein, in the third pre-assembled position, a finger of the stiffener abuts the bottom flange.

14. The method of claim 9 wherein, in a fifth pre-assembled position, a hinge is coupled to the stiffener.

15. The method of claim 14 wherein, in the fifth pre-assembled position, a portion of the hinge is received within a gap in the stiffener.

16. The method of claim 15 wherein, in the fifth pre-assembled position, a portion of the hinge passes through a space between the inner and outer doors.

* * * * *